US006657520B2

(12) United States Patent
Mack et al.

(10) Patent No.: US 6,657,520 B2
(45) Date of Patent: Dec. 2, 2003

(54) WAVEGUIDE FILTER

(75) Inventors: Paul Mack, Stittsville (CA); Michael Cooper, Aylmer (CA)

(73) Assignee: Dragonwave, Inc., Kanata (CA)

( * ) Notice: Subject to any disclaimer, the term of this patent is extended or adjusted under 35 U.S.C. 154(b) by 38 days.

(21) Appl. No.: 09/978,556

(22) Filed: Oct. 18, 2001

(65) Prior Publication Data

US 2002/0097116 A1 Jul. 25, 2002

(Under 37 CFR 1.47)

Related U.S. Application Data

(60) Provisional application No. 60/241,000, filed on Oct. 18, 2000.

(51) Int. Cl.[7] ..... H01P 1/207
(52) U.S. Cl. ..... 333/208; 333/212
(58) Field of Search ..... 333/135, 208–210, 333/212, 239

(56) References Cited

U.S. PATENT DOCUMENTS 3,271,706 A * 9/1966 Rooney ..... 333/210
3,587,008 A * 6/1971 Tsuda ..... 333/212
3,597,710 A * 8/1971 Levy ..... 333/210
3,949,327 A * 4/1976 Chapell ..... 333/210
4,800,349 A * 1/1989 Gurcan et al. ..... 333/208
4,833,428 A * 5/1989 Mok et al. ..... 333/135
6,181,224 B1 1/2001 Glinder ..... 333/208
6,392,508 B1 * 5/2002 Damphousse et al. ..... 333/209
6,476,696 B1 * 11/2002 Mack ..... 333/248

FOREIGN PATENT DOCUMENTS

JP 57041702 3/1982
JP 57070942 4/1982

* cited by examiner

*Primary Examiner*—Seungsoek Ham

(57) ABSTRACT

An E-plane waveguide is provided comprising a housing having opposed walls defining a waveguide channel. The waveguide includes at least two elements spaced apart in a direction along the waveguide channel and disposed between and spaced from the opposed walls, and which define a resonant cavity therebetween with the waveguide channel. At least one of the walls has first and second protrusions which are spaced apart in a direction along the waveguide channel and protrude into the waveguide channel. The spacing between the protrusions is less than half a wavelength of the resonant frequency of the resonant cavity.

25 Claims, 10 Drawing Sheets

WAVEGUIDE FILTER

This application claims the benefit of Provisional Application No. 60/241,000, filed Oct. 18, 2000.

FIELD OF THE INVENTION

The present invention relates to waveguide filters and in particular, but not limited to waveguide filters for RF waves.

BACKGROUND OF THE INVENTION

Radio transmitters and receivers require filters to remove or suppress unwanted frequencies from being transmitting or received. The transmitter portion of the radio may generate frequencies which will interfere with the radio system, or which may be prohibited by the radio frequency spectrum governing body. The receiver may need to suppress unwanted signals at different frequencies generated by the transmitter, or received from an external source, which would adversely affect the performance of the receiver.

At millimeter-wave frequencies sources of unwanted frequencies include the local oscillator frequency, image frequencies from the mixer, and the transmitter frequencies (in the case of the receiver). The frequencies generated by the mixer and the local oscillator are functions of the selected radio architecture. The closer the oscillator frequency (or its harmonics) is to the transmitter frequencies, the more difficult it is to remove the undesired frequency. However, wider spaced frequencies may result in more complex circuitry resulting in a more expensive radio implementation. A small separation between the transmit and receive frequencies can result in unwanted high power transmit frequencies leaking into the receiver. The separation between the transmit and receive frequencies is usually specified by the licensing bodies and the system operators. The radio designer may not have control over this specification.

To suppress the unwanted frequencies below an acceptable power level, a filter element is required in the signal path. The filter element discriminates between the desired and undesired frequencies based on the wavelengths of the signals. At millimeter-wave frequencies the difference between the wavelengths is very small, resulting a in very high manufacturing tolerances.

A common millimeter-wave filter is based on the metal rectangular waveguide, an example of which is shown in FIGS. 1*a* and 1*b*. The waveguide 1 comprises a series of resonant cavities 3 separated by partitions S. Each partition has an aperture or iris 7 to permit coupling of electromagnetic energy between the resonator cavities 3. Adjustable posts or tuning screws 9 extend into each cavity to provide a means of adjusting the resonant frequency of each cavity which is dependent on the cavity volume. A rectangular waveguide is used for its low loss characteristics. The resonant elements which when combined generate the filter response are formed in the waveguide mainly through the use of irises and posts. The resonant sections 3 are formed from lengths of waveguide multiples of one half wavelength long, with the size and placement of the irises or posts determining the coupling between the resonators and hence the frequency behaviour of the filter.

For the filter to discriminate between closely spaced frequencies, the physical dimensions must be extremely accurate. In practice it is difficult and costly to achieve the required dimensional accuracy. Historically many millimeter-wave applications did not require high volume production, and thus the investment to achieve the necessary accuracy was not warranted. Adjustable tuning screws were included in the design and after manufacture and assembly each filter was individually tuned, manually or automatically, to achieve the desired frequency response.

The use of tuning screws results in increased costs when compared to machined or case filters due to the more complicated assembly and tuning steps in the manufacturing process. Examples of these filters are disclosed in the publications of commercial millimeter-wave waveguide filter or diplexer component manufacturers, such as Microwave Development Company Inc., Lark Engineering, or X&L Microwave Inc.

A typical metal insert or E-plane filter is shown in FIGS. 2*a* and 2*b*. The waveguide housing 10 is split into two sections 12, 14, along the middle of the long dimension. The metal insert piece or septum 16 behaves as a series of posts when the filter is assembled. The accuracy of fabrication of the metal insert piece, which is normally etched and has a dimensional accuracy of ±0.1 mil (i.e. 0.0001 inches) is sufficient to ensure that there is no significant affect on the filter response at millimeter-wave frequencies. The frequency of operation of the filter is therefore set by the accuracy of the depth "d" of the waveguide housing, as shown in FIG. 2*a*.

A benefit of the metal insert filter is that the same housing can be used for different filters at different frequencies. Only the metal insert piece needs to be changed, and there is not a significant setup charge for changes in the metal insert piece.

To achieve the tight filtering requirements for closely spaced local oscillator and transmit frequencies, or between transmit and receive frequencies, for LMDS (Local Multipoint Distribution Service) radio applications the accuracy of the depth of the waveguide housing needs to be better than +/−1 mil. This level of accuracy can be achieved with quality machining, but is expensive to achieve for volume production.

SUMMARY OF THE INVENTION

According to one aspect of the present invention, there is provided an E-plane waveguide comprising a housing having opposed walls and defining a waveguide channel therebetween, at least two elements spaced apart in a direction along the waveguide channel and disposed between and spaced from said opposed walls and defining a resonant cavity therebetween with said waveguide channel, wherein at least one of said walls has first and second regions separated in a direction along said waveguide channel, at least one of said first and second regions being disposed opposite the aperture formed between said elements, and a third region between said first and second regions, and wherein said first and second regions protrude into said waveguide channel relative to said third region, and the spacing between said first and second regions in a direction along said waveguide channel is less than half a wavelength of the resonant frequency of said resonant cavity.

Advantageously, the inventors have found that providing the cavity wall with a structured surface having protrusions which extend into the cavity can significantly reduce the frequency shift of a waveguide filter due to errors in the width of the waveguide channel caused by the manufacturing process.

In one embodiment, at least one of the first and second regions comprises a discrete protrusion extending into the cavity relative to the third region.

In one embodiment, at least one dimension of the first region or protrusion is different from at least one corresponding dimension of the second region or protrusion. Advantageously, this feature may promote statistical variations in the manufacturing error by increasing the chance that protrusions having different dimensions will be subjected to slightly different manufacturing process conditions.

In one embodiment, the maximum dimension of the or each discrete protrusion transverse to a line perpendicular to the plane of the wall from which the or each protrusion extends is less than or equal to the spacing between itself and the other region or protrusion. Advantageously, this feature allows the protrusions to be rotated, for example for the purpose of adjusting their height and is particularly advantageous in the design and testing of a template of a waveguide housing section, which may be used to produce a cast or mold.

According to another aspect of the present invention, there is provided a housing section for an E-plane waveguide comprising a first wall and a second wall for forming part of said waveguide, said first wall adjoining said second wall, and in use, said first wall spacing said second wall from a septum of said E-plane waveguide, and wherein the side of said second wall which, in use, faces the waveguide channel, has said first and second regions spaced apart in a direction along said housing section, and a third region being positioned between said first and second regions, said first and second regions protruding from said second wall relative to said third region, and wherein the spacing between said first and second regions in a direction along the waveguide housing section is such that resonance of the frequency to be resonated within a cavity of an E-plane waveguide formed by said housing section is prevented.

According to another aspect of the present invention, there is provided a cast for manufacturing a waveguide housing section, the cast of having a form adapted to form a waveguide housing section as described herein.

According to another aspect of the present invention, there is provided a method of forming a cast for manufacturing a waveguide housing section, comprising the steps of: forming a template waveguide housing section, the waveguide housing section comprising a waveguide channel wall having a plurality of projections extending from the wall and being spaced apart along the wall, and forming a cast which conforms to the shape of said wall containing said projections.

According to another aspect of the present invention, there is provided a waveguide filter having a opposed walls and defining a channel therebetween, wherein the surface of at least one of the walls defining the channel defines a plurality of projections spaced apart in a direction along the length of the channel, wherein the spacing between adjacent projections is less than half a wavelength of the RF signal intended to be passed by the filter.

According to another aspect of the present invention there is provided a resonator for resonating an RF wave having a predetermined frequency and wavelength, the resonator comprising a resonant cavity having a wall, the wall having first, second and third regions, the third region being positioned between the fist and second regions, wherein the first and second regions protrude into the cavity relative to the third region wherein the distance between the first and second regions is less than half said predetermined wavelength.

In one embodiment, at least one of said first and second regions comprises a discrete protrusion extending into the cavity relative to the third region.

One embodiment further comprises one or more spaced apart further regions which protrude into said cavity relative to said third region, wherein the closest separation between adjacent projecting regions is less than half said predetermined wavelength.

In one embodiment, the closest separation between at least two projecting regions is one third of said predetermined wavelength or less.

According to the present invention there is further provided a resonator for resonating an RF wave having a predetermined frequency and wavelength comprising a resonant cavity having at least two spaced apart projections on the same side of said cavity, the ends of said projections defining part of the wall of said cavity, the distance between said projections being less than half said predetermined wavelength.

According to the present invention, there is also provided a waveguide comprising a channel for receiving electromagnetic waves and having opposed walls, the inside surface of at least one of said opposed walls being defined by at least two projections, spaced apart in a direction along the length of said channel, wherein the distance between the projections in a direction along the length of the channel is less than half the predetermined wavelength of electromagnetic waves to be passed through said waveguide.

In one embodiment the maximum dimension across the end of at least one projection defining the wall of the channel, in direction along the length of the channel is less than a half of said predetermined wavelength.

In one embodiment a portion a portion of each of said opposed walls of said channel are defined by at least two said projections.

One embodiment further comprises an element between said opposed walls and extending in a direction along the length of said channel and defining an aperture therethrough, the dimension of said aperture in direction along the length of said channel defining said predetermined resonant wavelength of said RF wave, at least a portion of at least one of said projections being positioned opposite said aperture.

In one embodiment the element comprises a plurality of apertures positioned successively along the length of said channel, a dimension of each aperture along the length of said channel defining a resonant wavelength of an RF wave to be passes through said waveguide.

In one embodiment at least one aperture defines a different resonant wavelength to another said aperture.

BRIEF DESCRIPTION OF THE DRAWINGS

Examples of embodiments of the present invention will now be described with reference to drawings, in which.

DESCRIPTION OF EMBODIMENTS

Figure 1A:
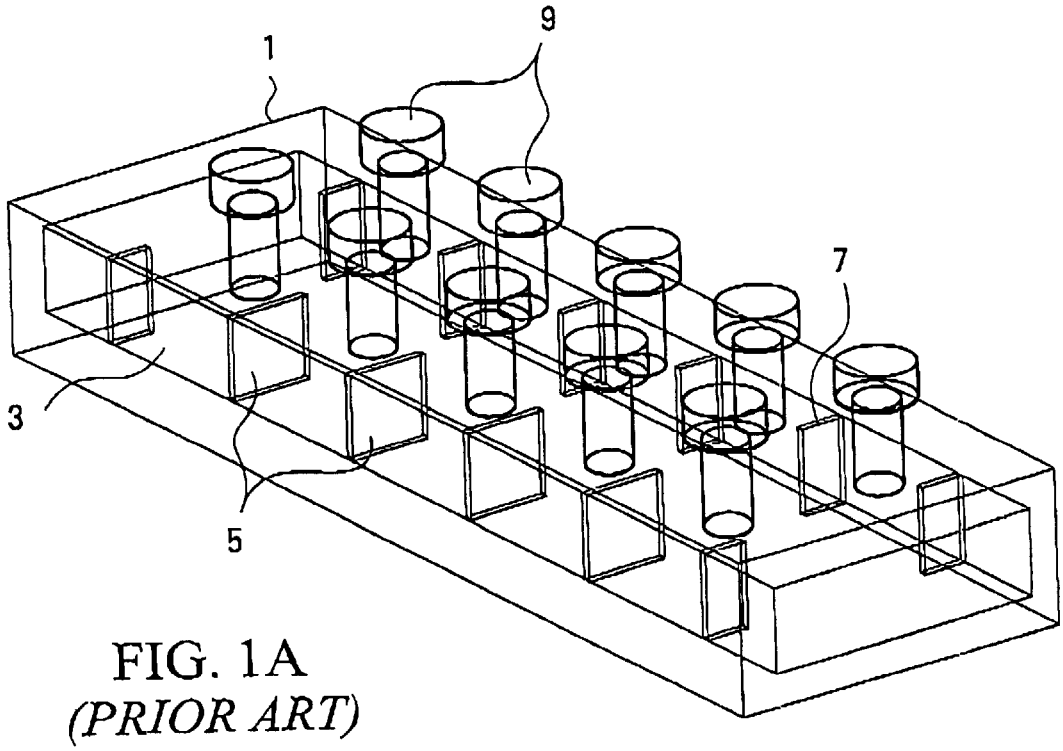
FIG. 1A (PRIOR ART)
FIGS. 1*a* and 1*b* show an example of waveguide filter according to the prior art.
Figure 1B:
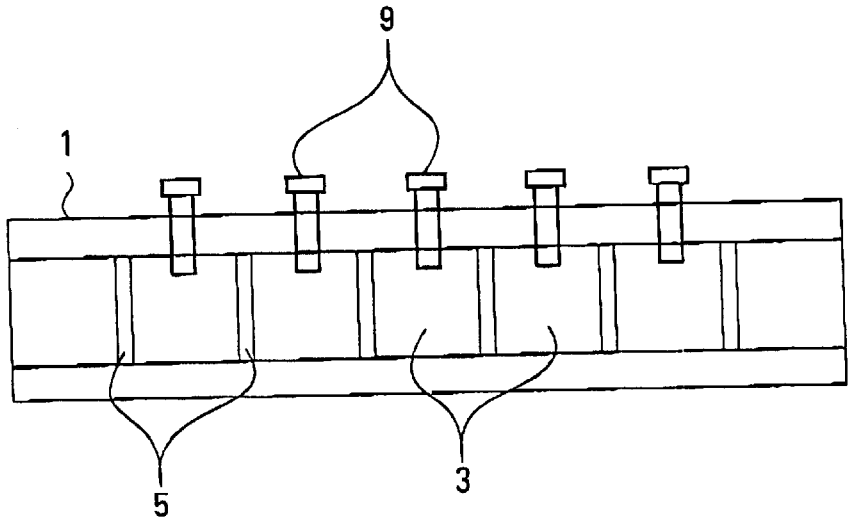
FIG. 1B (PRIOR ART)
Figure 2A:
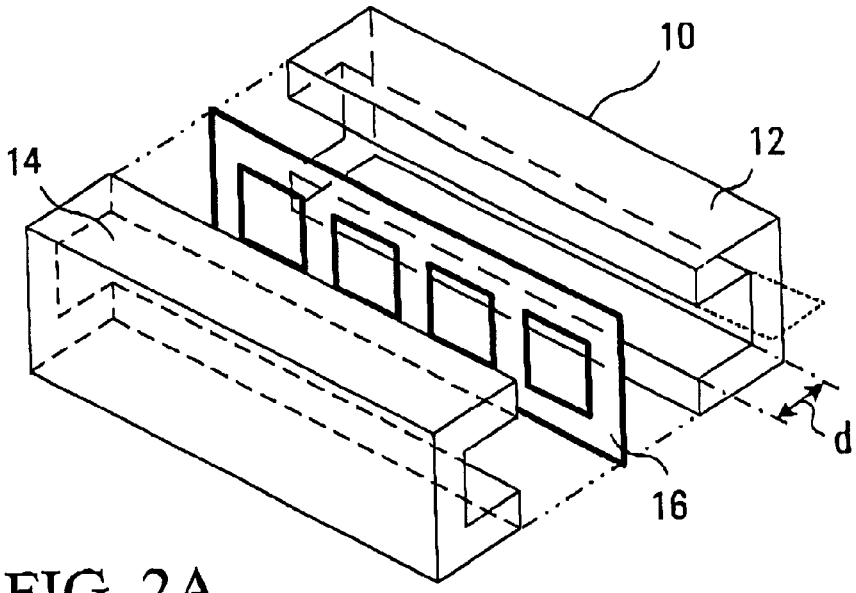
FIG. 2A (PRIOR ART)
FIGS. 2*a* and 2*b* show another example of a waveguide filter according to the prior art.
Figure 2B:
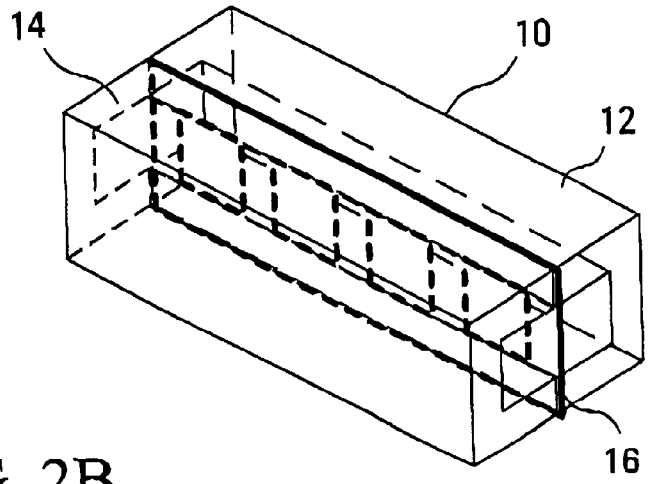
FIG. 2B (PRIOR ART)
Figure 3:
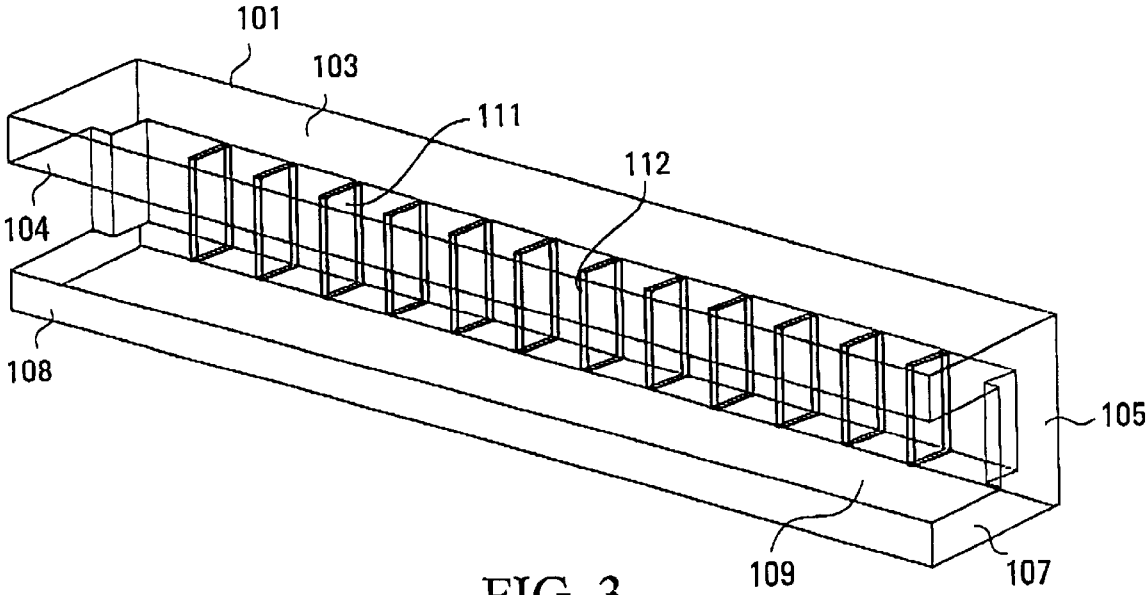
FIG. 3 shows a perspective view of an example of a waveguide housing section according to an embodiment of the present invention.

Referring to FIG. 3, a section 101 of a waveguide housing, according to an embodiment of the present invention, comprises an elongate channel section having first, second and third walls 103, 105, 107 defining a waveguide channel 109. A plurality of projections 111 are provided along the second wall 105 within the waveguide channel 109. In this embodiment, the projections 111 are rib-like structures which extend substantially perpendicular to the length of the waveguide channel, and between the opposed first and third walls 103, 107. Also in this embodiment, the rib structures 111 are generally rectangular when viewed along the length of the waveguide channel 109.

Figure 4:
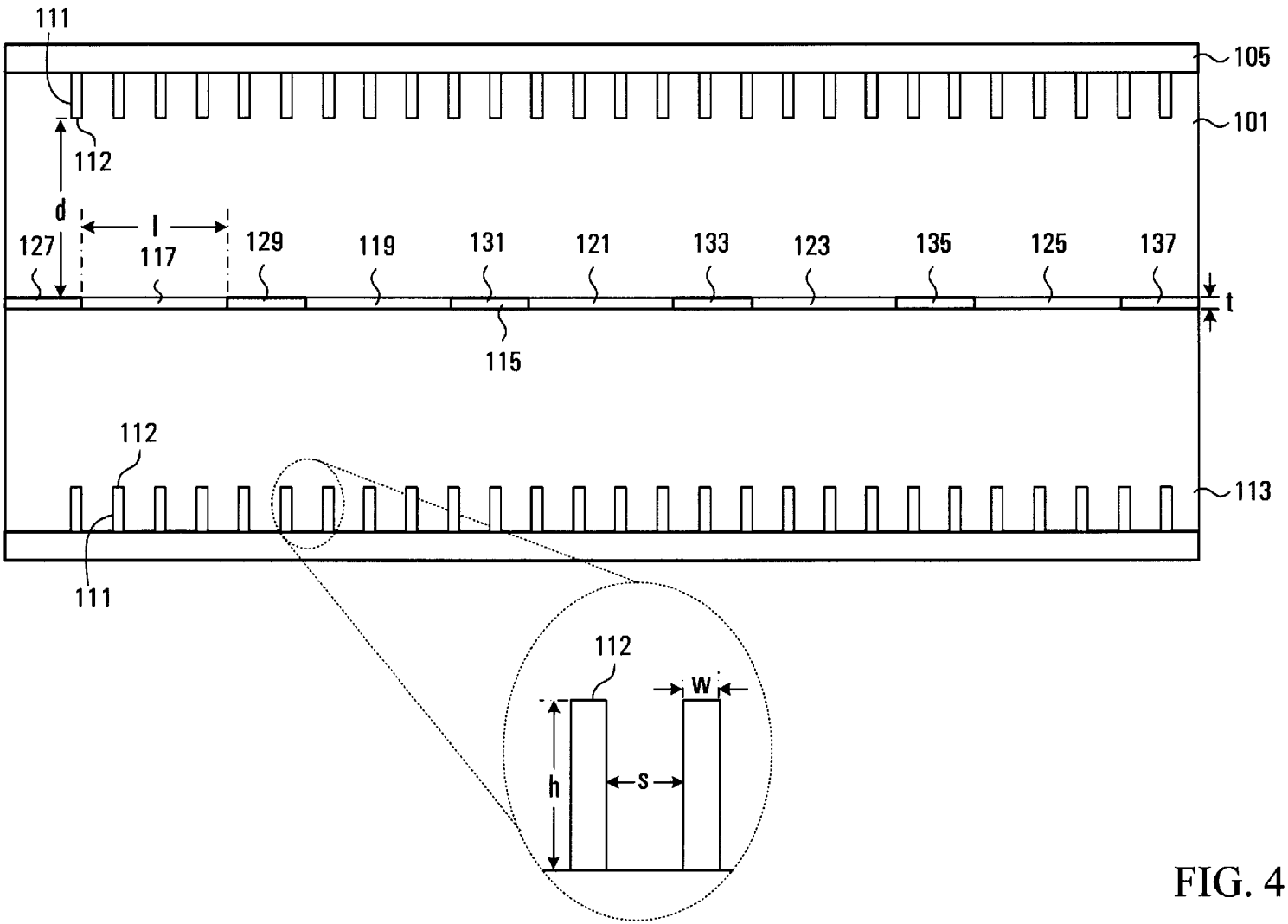
FIG. 4 shows a plan view of an E-plane filter according to an embodiment of the present invention.

FIG. 4 shows an E-plane filter comprising a pair of opposed waveguide sections 101, 113 and a septum 115 extending along the length of the waveguide. The septum 115, which may comprise metal or metallic foil or any other suizable material, includes a plurality of apertures 117 to 125 defined by regions of electrically conductive material 127 to 137. Each opening of 117 to 125 defines, with waveguide channel walls a resonant cavity, and each region of the septum between adjacent openings defines a coupling section, for coupling electromagnetic energy from one cavity to another. The inner surface of the second wall 105 of each waveguide housing section 101 is provided with projections which extend into the waveguide channel and are distributed along the length of the waveguide. The spacing "s" between adjacent projections in the direction along the waveguide channel, as shown in the expanded view of part of the waveguide housing section, should be less than half the wavelength of the frequency to be passed by the E-plane filter, to prevent resonance of this frequency between adjacent projections. The pass frequency of the filter depends on both the length "l" of the apertures 117 to 125 of the septum 115 and the depth of the waveguide channel. In contrast to standard E-plane filters in which the channel walls are smooth and flat and the depth of the waveguide channel is measured from the flat surface to the edge of the housing section, in embodiments of the present invention, the depth of the channel which determines the pass frequency is the distance "d" between the end 112 of each projection and the edges 104, 108 (shown in FIG. 4) of the housing section, or the width of the waveguide channel between the planes containing the ends of the projections disposed along the opposite walls.

Generally, in manufacturing known waveguide housings in which the inner walls of the housing are flat, any error in the depth of the waveguide channel, caused by manufacturing tolerances, is likely to be constant along the length of the waveguide channel, and produces a frequency shift dependent on the size of the error. For example, depending on the intended pass frequency, an error of 0.001 inches can cause a frequency shift of 70 MHz.

In embodiments of the present invention, the provision of projections along the waveguide channel wall which wall determines the pass or operating frequency, allows statistical variations, caused by the manufacturing process, to be introduced in the height "h" of the projections (i.e. the extent to which the projections extend from the wall) and therefore in the depth of the waveguide channel that determines the operating frequency. The depth of the waveguide channel will therefore not be constant along the waveguide due to the statistical independence of feature dimensions for manufacturing processes such as casting and molding. The height of some projections will be less than the desired height, and therefore the depth "d" of the waveguide channel will be greater than desired, while the height "h" of other projections will be greater than the desired height and therefore the depth "d" of the waveguide channel will be less than desired. The inventors have found that the operating frequency is dependent on the average depth of the waveguide channel, so that the variations in the height of the projections causes an averaging effect with the result that the average depth more closely approaches the desired depth for the particular operating frequency. The magnitude of the frequency shift of the filter is a function of the average height of the projections, and the averaging effect has been found to produce significantly less frequency shift than the relatively uniform error that results when manufacturing a flat surface waveguide housing.

The structured surface waveguide housing is easier and cheaper to mass produce than a typical flat surface waveguide because the manufacturing tolerances are reduced.

By way of example, the tolerance on the depth of a flat surface waveguide needs to be 1% to achieve a frequency response within a specified range. To achieve the same maximum shift of the frequency response within this specified range using a structured surface waveguide housing with four ribs per resonator section (i.e. two on each side of the cavity), the required tolerance on the depth of the waveguide channel (measured from the ends of the ribs) can be relaxed to 2%. This is due to the statistically independent nature of the variance of the depth of each rib. If there are 5 resonator sections in the filter, then for the same example the manufacturing tolerance can be relaxed further to 4.5%. Distortion in the frequency response or limited statistical independence between adjacent ribs may limit the required tolerance to less than 4.5%.

For high volume precision metal casting or plastic molding, the averaging affect of the statistical variation of the height of the ribs results in lower accuracy requirements for the manufacture of the waveguide housing. The manufacturing of the complete filter unit incorporating the invention has a higher yield for a lower cost than standard waveguide manufacturing technology.

The specific height of the ribs does not significantly impact the frequency of the filter. However, in one embodiment, the height of the projections should be sufficient to allow statistical variations in the height between different projections to be introduced by the manufacturing process. The likelihood of introducing such variations may be increased by increasing the height of the projections so that the ends are further away from the surface of the wall from which they extend. By way of example, the height of the projections may be at least 0.03 inches, for example in the range of 0.03 and 0.1 inches or more.

In one embodiment, the same height may be selected for all projections. In another embodiment, different heights may be selected for different projections to increase the probability that different projections will be subjected to different manufacturing conditions, so that the process-induced error in the projection height will be different for different projections. For example, different heights may be deliberately selected for adjacent projections which, due to their proximity, are more likely otherwise to be subjected to the same manufacturing conditions and therefore to the same process-induced height error. In casting or molding, process-induced errors in the height of the projections may be caused by differences in temperature, rate of change of temperature, pressure or rate of change of pressure between different positions of the waveguide housing. By imposing a variation in the height of different projections, some projections will have parts which are further away from the waveguide wall from which they extend than other projections, and therefore may be subjected to different manufacturing conditions such as temperature and pressure.

The spacing between the ribs or other projections should be less than one half of the guide wavelength at the frequency of operation. For example, the spacing between adjacent projections along the length of the waveguide may be in the range of ⅕ to ⅓ of the waveguide length at the frequency of operation. Generally, the minimum spacing between adjacent projections should be sufficient to enable the projection to be manufactured by the desired manufacturing process.

The width of the projections i.e. their dimension in a direction along the length of the waveguide should also be less than half the wavelength of the operating frequency. Preferably the width is sufficient to allow the projections to be formed by the manufacturing process with sufficient strength and integrity for the intended use.

The dimension of the projections in a direction transverse to their width, i.e. their length, can be any suitable size. The length generally is not critical or required to prevent resonance in that direction, since the height of the waveguide channel is usually less than half the wavelength of the operating frequency. However, preferably the length of its projections is sufficient to provide the desired or requisite strength. For example, the ratio of the height to the length of the projections may be 1:1.

The presence of the gap between adjacent projections may have an effect on the value of the operating frequency and may have to be considered in determining the critical transverse distance between the channel walls or the depth of the waveguide channel. Generally, the critical transverse dimension of the waveguide channel that determines the frequency of operation is the distance between the opposed channel walls. If projections are provided on both walls, and for a given wall are selected to have a constant height, the critical dimension may be measured between the two planes containing the end of the projections on both walls. If the projections on one or both walls have different selected heights, the position from which the critical dimension is measured may be the plane containing the average selected height of the projections. If one wall of the waveguide channel is flat, the critical dimension may be measured from the appropriate plane containing projections, as defined above, and the opposed flat wall.

One method which may be employed to determine the required dimension between the channel walls and therefore the height of the projections for a desired operating frequency is firstly to determine the distance between opposite sides of a waveguide with flat sides for the desired operating frequency and then to reduce this distance slightly to compensate for the effect of the gap between adjacent projections. In the case of an embodiment having projections on both sides of the waveguide housing, the compensated distance is the distance between two planes containing the ends of projections having an average height on each side of the waveguide housing, and in the case of an embodiment with projections on one side of the waveguide housing only, the compensated distance is the distance between a plane containing the ends of projections having an average height over the projections on one side of the housing and the flat wall on the opposite side of the housing.

Figure 5:
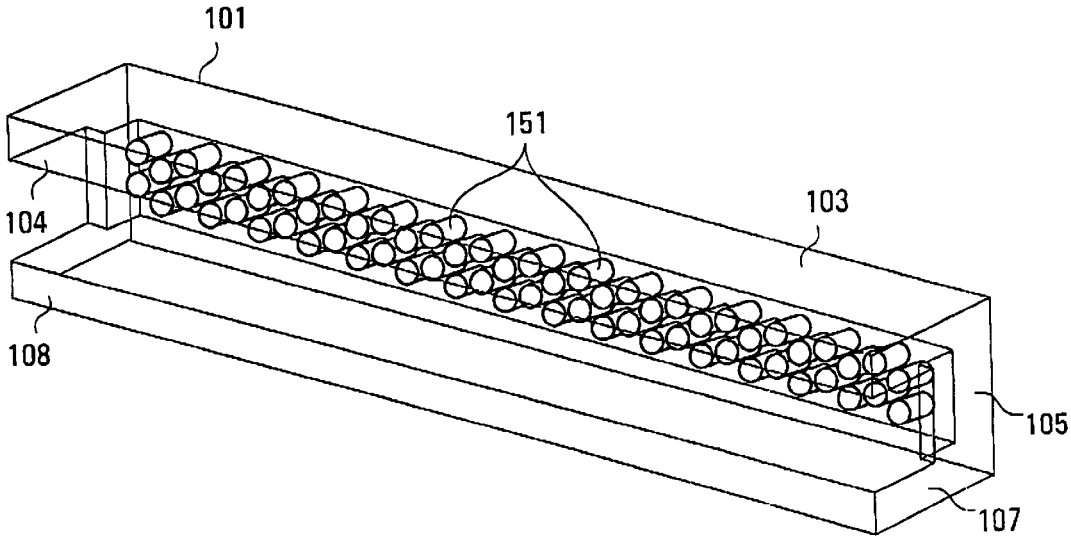
FIG. 5 shows a perspective view of a waveguide housing section according to another embodiment of the present invention.
Figure 6A:
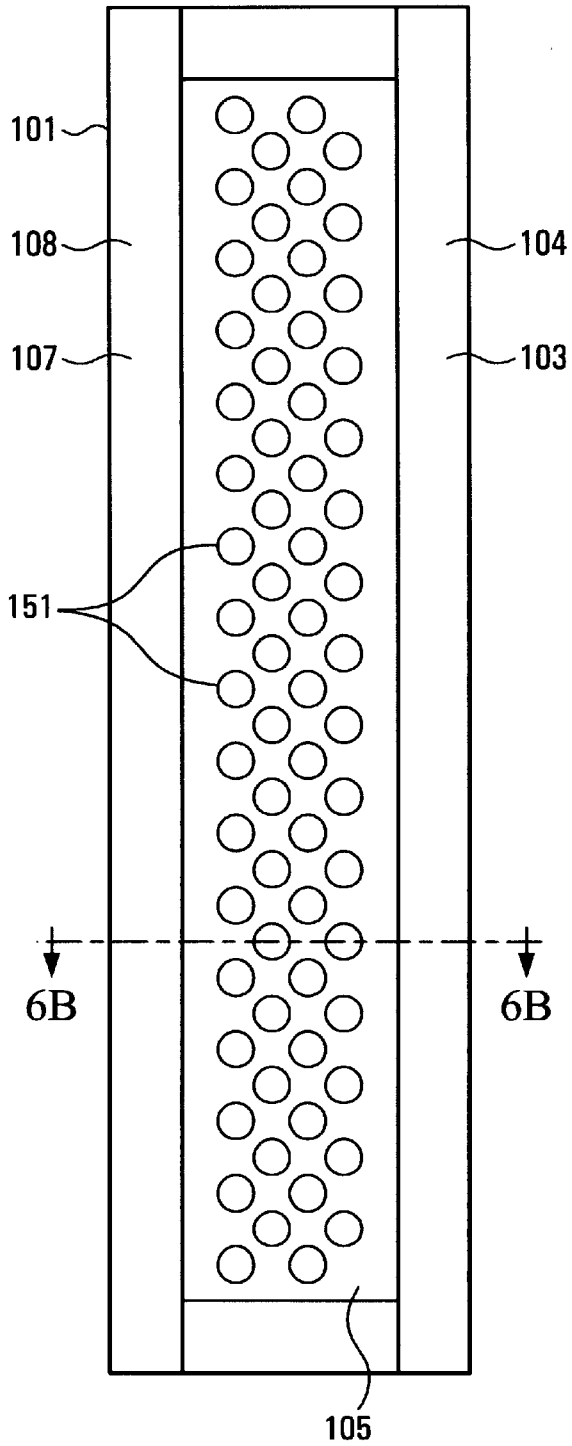
FIG. 6 shows a side view of the embodiment of FIG. 5.
Figure 6B:
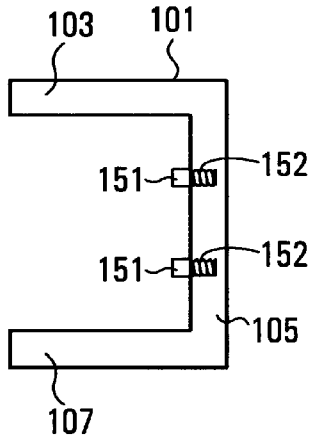

FIG. 5 shows a waveguide housing section according to another embodiment of the present invention. The basic structure of the waveguide housing section is similar to that shown in FIG. 3, and like parts are designated by the same reference numerals. The main difference between this embodiment and that shown in FIG. 3, is that in the embodiment shown in FIG. 5, the projections have the form of posts 151, rather than ribs. In this embodiment, the posts are arranged in a two dimensional array, as shown in FIG. 6. The spacing between the posts is selected so that the desired pass or operating frequency does not resonate between the posts. The waveguide housing may be designed with the same height selected for all the posts, or different heights may be selected for different posts, for example in order to increase the probability of different manufacturing errors being applied to different posts to improve the averaging effect. For example, in one embodiment one or more posts may be selected to have a different height to one or more adjacent posts. In other embodiments, the posts may be positioned according to any suitable repeating pattern, or may be positioned randomly or quasi-randomly.

Advantageously, the use of posts may facilitate the manufacture of a cast or mold for forming the or each waveguide housing section. In the original template of the waveguide housing section used to form the cast, the posts may be screwed into the waveguide wall which allows their height to be easily adjusted by turning the posts. The performance of the template itself may be tested in one or more implementations of a waveguide, and its performance finally tuned by adjusting the height of the projections. Once the tuning process is complete, a cast can be made directly from the template.

Figure 7:
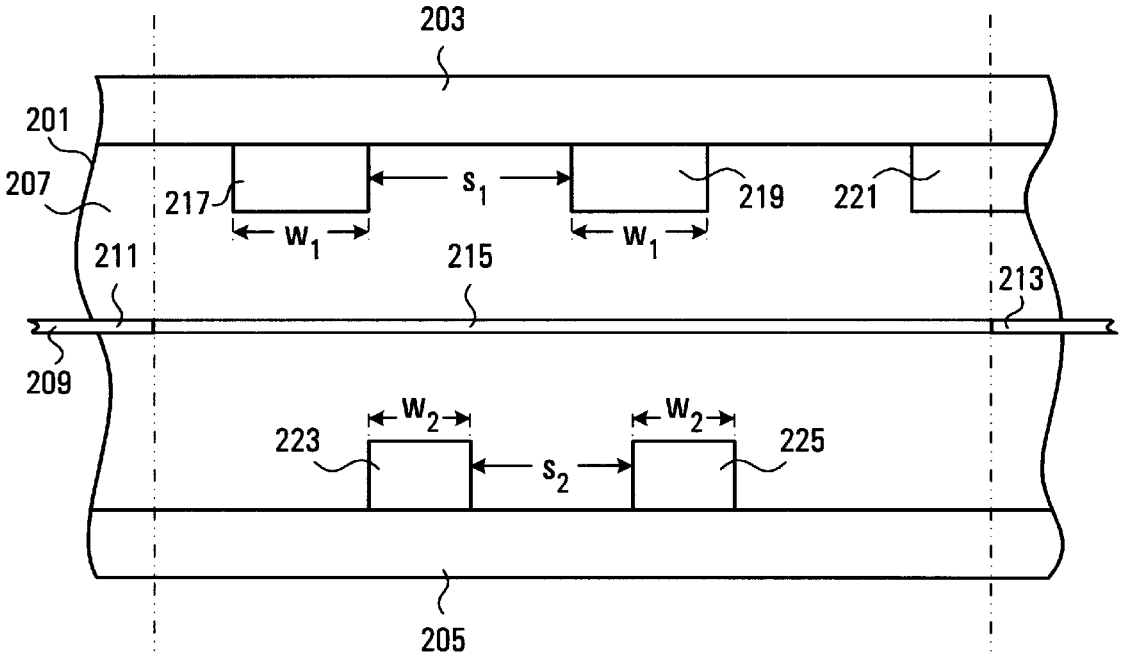
FIG. 7 shows a plan view through a resonant cavity according to an embodiment of the present invention.

In other embodiments of the present invention, at least one the shape, size and placement of projections along one side of the waveguide channel can be different from that of projections along the other side of the waveguide channel. An example of such an embodiment is illustrated in FIG. 7, which shows a plan view through a section of a waveguide housing. The waveguide housing 201 comprises two opposed walls 203, 205, defining a waveguide channel 207 therebetween. A septum 209 is positioned between the opposed walls 203, 205, extends along the waveguide channel 207 and includes conductive elements 211, 213, one or more of which may serve as coupling sections, and an aperture 215 which defines a resonator or resonant cavity between the opposite sides 203, 205, of the waveguide channel.

A plurality of projections 217, 219, 221, are provided along one of the waveguide channel walls 203, and a plurality of projections 223, 225, are provided along the other waveguide channel wall 205. In this embodiment, the spacing "$s_1$" between the projections 217, 219, 221 on one side of the waveguide channel is different from the spacing "$s_2$" of the projections 223, 225 on the other side of the waveguide channel. Both spacings, "$s_1$" and "$s_2$" are less than half the wavelength of the resonant frequency to prevent resonance of this frequency between the projections. In this embodiment, the width of the projections (i.e. the dimension of the projections along the length of the waveguide channel) "$w_1$" of the projections 217, 219, 221, on one side of the waveguide channel is different from the width "$w_2$" of the projections 223, 225, along the other side of the waveguide channel. Also, in this embodiment, the position of the projections 217, 219, 221, along one side of the waveguide channel are offset in a direction along the waveguide channel relative to the projections 223, 225, along the other side of the waveguide channel.

The height of the projections along one side of the waveguide channel may be different from the height of the projections along the other side of the waveguide channel, and/or the shape of projections along one side of the waveguide channel may vary relative to one another.

Further examples of projection arrangements which may implemented in embodiments of the present invention are shown in FIGS. 8 to 13.

Figure 8:
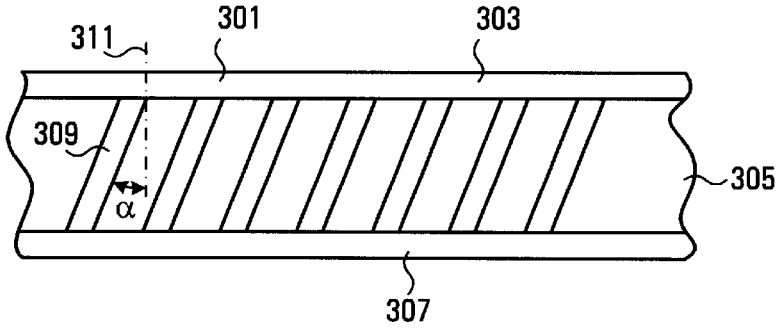
FIG. 8 shows a side view of a waveguide housing section according to another embodiment of the present invention.

FIG. 8 shows a side view of a waveguide housing 201, having first, second and third walls 303, 305, 307. In this embodiment, the projections 309 are provided along the second wall 305. The projections have the form of ribs and are arranged at an angle "$\alpha$" relative to a line 311 perpendicular to the length of the waveguide channel. Ribs along the or both waveguide channel walls may have the same angle or may be angled differently from one another.

Figure 9:
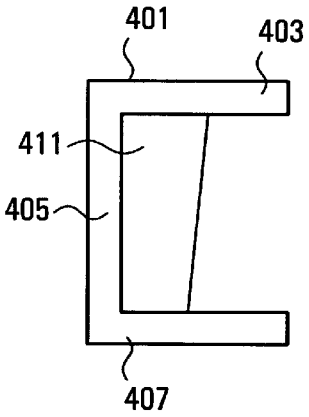
FIG. 9 shows an end view of a waveguide housing section according to another embodiment of the present invention.

FIG. 9 shows an end view through a waveguide housing section 401, in which the housing section has first, second and third walls 403, 405, 407 defining a waveguide channel 409. Projections 411 are provided along the second wall 405, and have the form of ribs. In this embodiment, the height of the ribs varies monotonically in a direction between the first and third walls 403, 407, and in this embodiment, the height of the ribs decreases from the first to the third wall.

Figure 10:
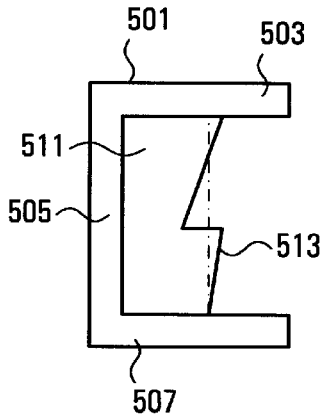
FIG. 10 shows an end view of a waveguide housing section according to another embodiment of the present invention.
Figure 11:
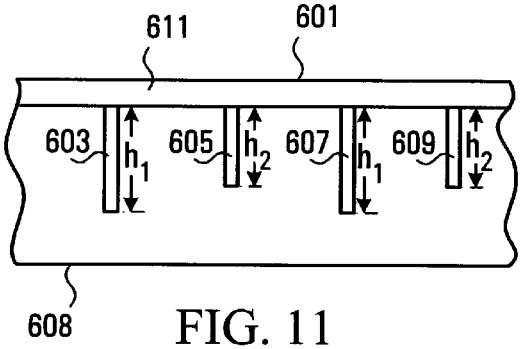
FIG. 11 shows a plan view through a waveguide housing section according to another embodiment of the present invention.
Figure 12:
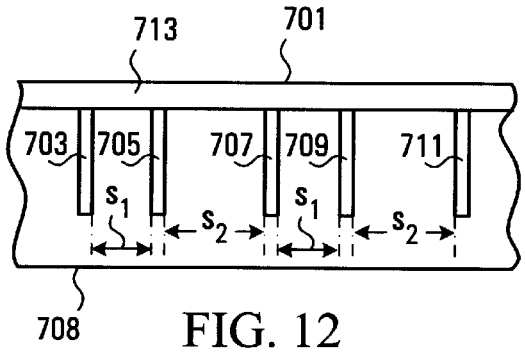
FIG. 12 shows a plan view through a waveguide housing section according to another embodiment of the present invention.

FIG. 10 shows an end view through another embodiment of a waveguide housing section 501, having first, second and third walls 503, 505, 507. In this embodiment, projections 511 have the form of ribs, and are provided along the second wall 505. In this embodiment, the edge 513 of the ribs have a saw tooth pattern. The saw tooth pattern may have any suitable amplitude and wavelength FIG. 11 shows a plan view through an embodiment of a waveguide housing section in which a plurality of projections 603, 605, 607, 609 are provided along a waveguide channel wall 611. In this embodiment, the heights of adjacent projections are different from one another FIG. 12 shows a plan view through another embodiment of a waveguide housing section 701, in which projections 703, 705, 707, 709, 711 are provided along a wall 713 of the waveguide channel section. This embodiment shows an example of a waveguide housing section in which the spacing between adjacent projections varies along the waveguide channel.

Figure 13:
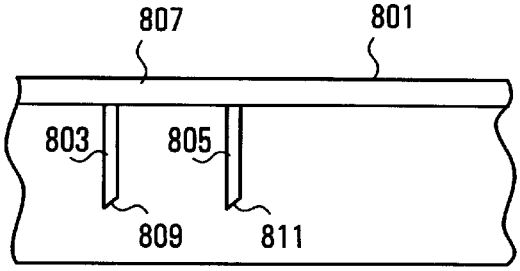
FIG. 13 shows a plan view through a waveguide housing section according to another embodiment of the present invention.

FIG. 13 shows a plan view through another embodiment of a waveguide housing section 801, having projections 803, 805 arranged along a wall 807 of the housing section. In this embodiment, the height of the projections, defined by their ends 809, 811 varies across their width, i.e. in a direction along the length of the waveguide channel.

Embodiments of a waveguide housing section may incorporate one or more projections having any one or a combination of any two as in one of the features of the projection arrangements described above. In other embodiments, a projection, or its upper surface may be discontinuous between the first and third walls of the waveguide channel.

As described above, equivalent implementations of the structured waveguide surface that achieve the same or similar results include, but are not limited to, varying the rib height, varying the height along each rib (e.g. sawtooth pattern), using posts in place of the ribs, using multiple posts in the place of the ribs, varying the post height, and varying the post placement as well as others.

Advantages of embodiments of the invention over conventional, flat waveguide surfaces are the cost savings of avoiding post-assembly tuning and the enabling of the use of mass production casting or molding processes for the manufacturing of frequency specific components, such as filter, at millimeter-wave frequencies.

The uses and applications of embodiments of the invention include but are not limited to frequency or dimensionally sensitive components such as waveguide filters, for example to band pass and band stop filters as well as others, and waveguide diplexers, as well as other applications. Embodiments of the invention are particularly applicable at millimeter-wave frequencies due to the short wavelengths and high dimensional accuracy requirements.

Figure 14:
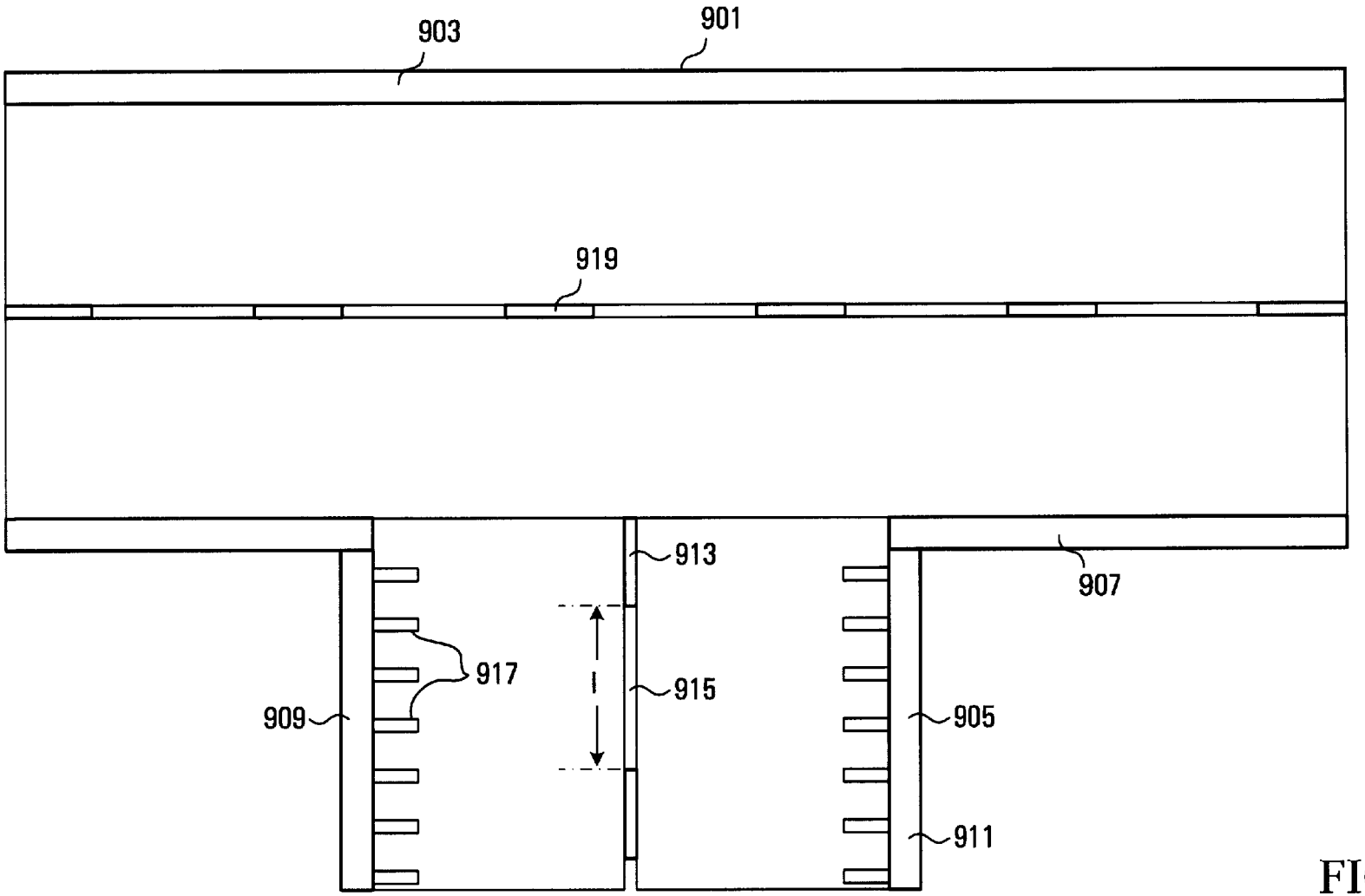
FIG. 14 shows a plan view through a housing section for a band stop filter according to another embodiment of the present invention.

FIG. 14 shows an example of a band-stop filter according to another embodiment of the present invention. The band stop filter 901 comprises a waveguide 903 and a band-stop section 905 extending from and adjoining a wall 907 of the waveguide 903. The band-stop section includes opposed walls 909, 911 and a septum 913 disposed therebetween and which defines one or more apertures 915 (for one or more resonant cavities), whose length 1 defines with the width of the band-stop channel the frequency to be removed from the r.f. signal propagating within the waveguide 903. Projections 917 extend from the walls 909, 911 of the bands-top section 905, the spacing between adjacent projections 917 being sufficient to prevent resonance of the operating frequency or band of frequencies of the filter. Optionally, the waveguide 903 may include a septum 919 and may further include projections (not shown) along one or both walls of the wave guide 903, in accordance with any of the embodiments described above.

Figure 15:
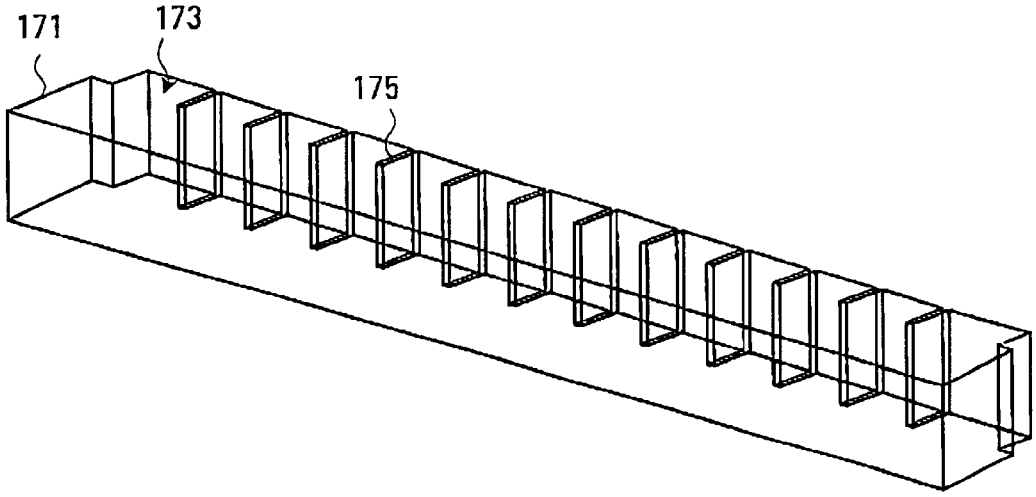
FIG. 15 shows a cast for making a waveguide housing section, according to an embodiment of the present invention.

FIG. 15 shows an embodiment of a cast for use in manufacturing a waveguide housing section according to an embodiment of the present invention. Referring to FIG. 15, the cast 171 includes a plurality of recesses 171 for forming the projections along a waveguide channel section wall and a plurality of protrusions 175 which form the recesses between the projections.

Any of the features of the embodiments described herein may be combined with any other features.

Modifications to the embodiments described herein will be apparent to those skilled in the art,

What is claimed is:

1. An E-plane waveguide comprising a housing having opposed walls and defining a waveguide channel therebetween, at least two elements spaced apart in a direction along the waveguide channel and defining an aperture therebetween, said elements being disposed between and spaced from said opposed walls and defining a resonant cavity therebetween with said waveguide channel, wherein at least one of said opposed walls has both respective first and second regions separated in a direction along said waveguide channel, at least one of said first and second regions being disposed opposite said aperture defined between said elements, and a respective third region between said first and second regions, and wherein said first and second regions protrude into said waveguide channel relative to said third region, and the spacing between said first and second regions in a direction along said waveguide channel is less than half a wavelength of the resonant frequency of said resonant cavity.

2. An E-plane waveguide as claimed in claim 1, wherein at least one of said first and second regions comprises a discrete protrusion extending into the waveguide channel relative to said third region, and at least a portion of said discrete protrusion is disposed opposite said aperture.

3. An E-plane waveguide as claimed in claim 2, wherein said first and second regions each comprises a discrete protrusion extending into said waveguide channel relative to said third region, and at least a portion of at least one of said first and second discrete protrusions is disposed opposite said aperture.

4. An E-plane waveguide as claimed in claim 1, wherein the spacing between said first and second regions in a direction along said waveguide channel is about one third of the wavelength of said resonant frequency or less.

5. An E-plane waveguide as claimed in claim 1, wherein at least one dimension of said first region is different to at least one corresponding dimension of said second region.

6. An E-plane waveguide as claimed in claim 5, wherein said first and second regions each define a protrusion and wherein said dimension is one of:

(a) the distance which said first and second regions extend into said waveguide channel relative to said third region, (b) the dimension of said first and second regions in a direction along the length of said waveguide channel, and (c) the dimension of said first and second regions in a direction transverse to said waveguide channel.

7. An E-plane waveguide as claimed in claim 2, wherein each of said first and second regions comprises a discrete protrusion and the maximum dimension of each discrete protrusion transverse to a line perpendicular to the plane of the opposed wall from which the protrusion extends is less than or equal to the spacing between itself and the other said discrete protrusion.

8. An E-plane waveguide as claimed in claim 7, wherein each protrusion comprises a post.

9. An E-plane waveguide as claimed in claim 2, wherein each discrete protrusion is adapted such that the distance which the protrusion extends into said waveguide channel is adjustable by varying the position of the protrusion relative to the opposed wall from which the protrusion extends.

10. An E-plane waveguide as claimed in claim 9, wherein each protrusion is adapted to engage the opposed wall from which it extends such that the distance which said protrusion extends into said waveguide channel is adjustable by varying the angular position of said protrusion relative to the opposed wall from which it extends.

11. An E-plane waveguide as claimed in claim 10, wherein the protrusion threadably engages said wall.

12. An E-plane waveguide as claimed in claim 1, comprising one or more further regions spaced apart from each other and from said first and second regions in a direction along said waveguide channel and which protrude into said waveguide channel relative to said third region, and wherein the separation between adjacent protruding regions in a direction along said waveguide channel is less than half said wavelength.

13. An E-plane waveguide as claimed in claim 1, wherein the maximum dimension across the end of at least one of said first and second regions in a direction along the length of the waveguide channel is less than half of said wavelength.

14. A housing section for an E-plane waveguide comprising a first wall and a second wall for forming part of said waveguide and for defining part of a waveguide channel, said first wall adjoining said second wall, and said first wall spacing said second wall from a septum of said E-plane waveguide, and wherein the side of said second wall which faces the waveguide channel has first and second regions spaced apart in a direction along said housing section, and a third region positioned between said first and second regions, said first and second regions protruding from said second wall relative to said third region, and wherein the spacing between said first and second regions in a direction along the waveguide housing section is such that resonance between said first and second regions of the frequency to be resonated within a cavity of an E-plane waveguide formed by said housing section is prevented.

15. A housing section as claimed in claim 14, wherein the spacing between said first and second regions in a direction along said housing section is equal to or less than the height of the side of said second wall which faces said waveguide channel.

16. A housing section as claimed in claim 14, wherein at least one of said first and second regions comprises a discrete protrusion extending from said second wall.

17. A housing section as claimed in claim 14, wherein the maximum dimension of at least one of said first and second regions in a direction transverse to a line extending perpendicular from said second wall is less than or equal to the spacing between said first and second regions.

18. A housing section as claimed in claim 14, wherein said first and second regions protrude a distance from said second wall, and the distance which at least one of said first and second regions extends from said second wall is adjustable by varying the position of said at least one of said first and second regions relative to said second wall.

19. A housing section as claimed in claim 18, wherein said extent is adjustable by varying the angular position of at least one of said first and second regions.

20. A resonator for resonating an RF wave having a predetermined frequency and wavelength, the resonator comprising a resonant cavity having opposed walls and first and second elements disposed between said walls and displaced therefrom and spaced apart in a direction along said walls, and wherein at least one of said walls has first and second regions spaced apart in a direction of the spacing between said elements, and a third region between said first and second regions, wherein said first and second regions extend into said cavity relative to said third region, and the spacing between said first and second regions in a direction along said wall is such as to prevent resonance between said first and second regions of said predetermined frequency.

21. A resonator as claimed in claim 20, wherein the spacing between said first and second regions is less than the spacing between said elements.

22. A resonator as claimed in claim 21, wherein said first and second regions are integral with said wall.

23. A waveguide comprising a channel for receiving electromagnetic waves and having opposed walls, the surface of at least one of said opposed walls being defined by at least two projections spaced apart in a direction along the length of said channel, wherein the spacing between the projections in a direction along the length of the channel is less than half a predetermined resonant wavelength of electromagnetic waves to be passed by said waveguide, and an element between said opposed walls and extending in a direction along the length of said channel and defining an aperture through said element, the dimension of said aperture in a direction along the length of said channel defining said predetermined resonant wavelength, and wherein at least a portion of at least one of said projections is positioned opposite said aperture.

24. A waveguide as claimed in claim 23, wherein said element comprises a plurality of apertures positioned successively along the length of said channel, a dimension of each aperture along the length of said channel defining a resonant wavelength of an RF wave to be passed through said waveguide.

25. An E-plane waveguide as claimed in claim 1, wherein each of said first and second regions has a volume and the volume of said first region is different to the volume of said second region.

* * * * *